United States Patent [19]

Toda

[11] 4,034,909

[45] July 12, 1977

[54] COLLAPSIBLE CONTAINER

[76] Inventor: Mitsunori Toda, 334 Moguso, Hino, Tokyo, Japan

[21] Appl. No.: 641,292

[22] Filed: Dec. 16, 1975

[30] Foreign Application Priority Data

Dec. 29, 1974 Japan ..... 50-000401[U]

[51] Int. Cl.[2] ..... B65D 5/36; B65D 13/04

[52] U.S. Cl. ..... 229/41 B; 229/23 R

[58] Field of Search ..... 229/23 R, 41 R, 41 B, 229/48 R, 49

[56] References Cited

U.S. PATENT DOCUMENTS

| | | | |
|---|---|---|---|
| 1,680,745 | 8/1928 | Morton | 229/49 X |
| 1,940,309 | 12/1933 | Lackey | 229/49 |
| 2,066,753 | 1/1937 | Weiss | 229/41 B |
| 2,761,609 | 9/1956 | Arkin | 229/23 R |
| 2,781,160 | 2/1957 | Bolding | 229/41 B |
| 3,099,379 | 7/1963 | Stease | 229/23 R |
| 3,251,533 | 5/1966 | Cohen | 229/23 R X |

*Primary Examiner*—Davis T. Moorhead
*Attorney, Agent, or Firm*—Morgan, Finnegan, Pine, Foley & Lee

[57] ABSTRACT

A collapsible container, formed from a blank of heavy paperboard or cardboard comprising four side walls interconnected with each other, first bottom wall means extending from the lower edges of a pair of the side walls adjacent to each other and inwardly foldable, second bottom wall means extending from the lower edges of another pair of the side walls adjacent to each other, a first score line on the first bottom wall means, a second core line on the second bottom wall means, and reinforcing members disposed on the opposite ends of the side walls. The carton as a whole may be very readily set up or collapsed by unfolding or folding the first and second bottom wall means over along the first and second fold lines. The first and second bottom wall means partially overlie each other to define the base.

7 Claims, 12 Drawing Figures

COLLAPSIBLE CONTAINER

BACKGROUND OF THE INVENTION

This invention relates to collapsible or folding containers, and more particularly to a container of carton, cardboard, or the like, which stands repeated and frequent use and is simple in to erect, collapse, and is of sufficient strength.

Various collapsible containers of carton or carboard have been heretofore proposed but they had less strength in construction. Those containers are thus limited to a single use or an accommodation of goods therein, and are not suitable for conveying or transporting goods. Notably, conventional collapsible containers are less resistive to longitudinal load and are easily be crushed or deformed if they receive therein goods which leave a considerable unfilled space or deformable goods, or if they are arranged in a stack or are subjected to heavy goods thereon. Well known collapsible containers are lack resistance to not only longitudinal load but also transverse load, thereby exhibiting torsional deformation.

Generally, a currently available folding container is arranged so that bottom flaps adjacent associated panels are laid to overlap each other. With this arrangement, the bottom flaps, if subjected to heavy goods, are readily disengaged from their overlap or are deformed, and then cannot hold out so that the bottom comes out.

In view thereof, it is customary, upon storage of goods in such a container, to fasten the bottom flaps together with a paper fastener or a staple, or to apply an adhesive tape to an overlap of the flaps. Because of the necessity of such reinforcement, difficulties are involved in application of such a conventional collapsible cardboard to articles of daily use such as a goods-delivery box. Further, a folding container according to the prior art, requires much labor for erection of the container.

SUMMARY OF THE INVENTION

It is thus a primary object of the present invention to provide a collapsible hexahedron cardboard container which is rigid and capable of simple folding and erection.

An object of the present invention is to provide a collapsible container which comprises four side walls interconnected with each other, first bottom wall means extending from the lower edges of a pair of the side walls adjacent to each other and inwardly foldable, second bottom wall means extending from the lower edges of another pair of the side walls adjacent to each other, fold lines on the first and second wall means whereby the carton may be instantaneously set up or collapsed by unfolding or folding the first and second bottom wall means over along the fold lines.

Still another object of the invention is to provide a collapsible container which is provided with hard and rigid reinforcing members mounted longitudinally on each of the side walls at the opposite ends thereof to provide improved stress resistance, thereby withstanding longitudinal and transverse external forces.

Yet a further object of the invention is to provide a collapsible container which comprises two pairs of bottom flaps extending from the lower edges of the respective side walls, each pair of the bottom flaps being joined by a connector to form bottom wall means so that the base of the container is of increased in strength.

Still yet another object of the present invention is to provide a collapsible container which includes four lid flaps integrally affixed to the respective side walls at the upper edges thereof and adapted to overlie each other in a manner that two pairs of oppositely disposed lid flaps are in close proximity to each other and one pair lies atop the other pair so that a substantially flat lid strength which withstand torsional force with the aid of hook means such as magic tape attached to the lid flaps.

Another object of the present invention is to provide a collapsible container which is can be folded flat when not in use, thus requiring a minimum of storage or transport space, which is easily and quickly erected for use, but which is fit for repeated uses, so that the container can function as a goods-delivery box.

These and other objects and features of the present invention will be evident in the following description.

DESCRIPTION OF THE PREFERRED EMBODIMENT

Figure 1:
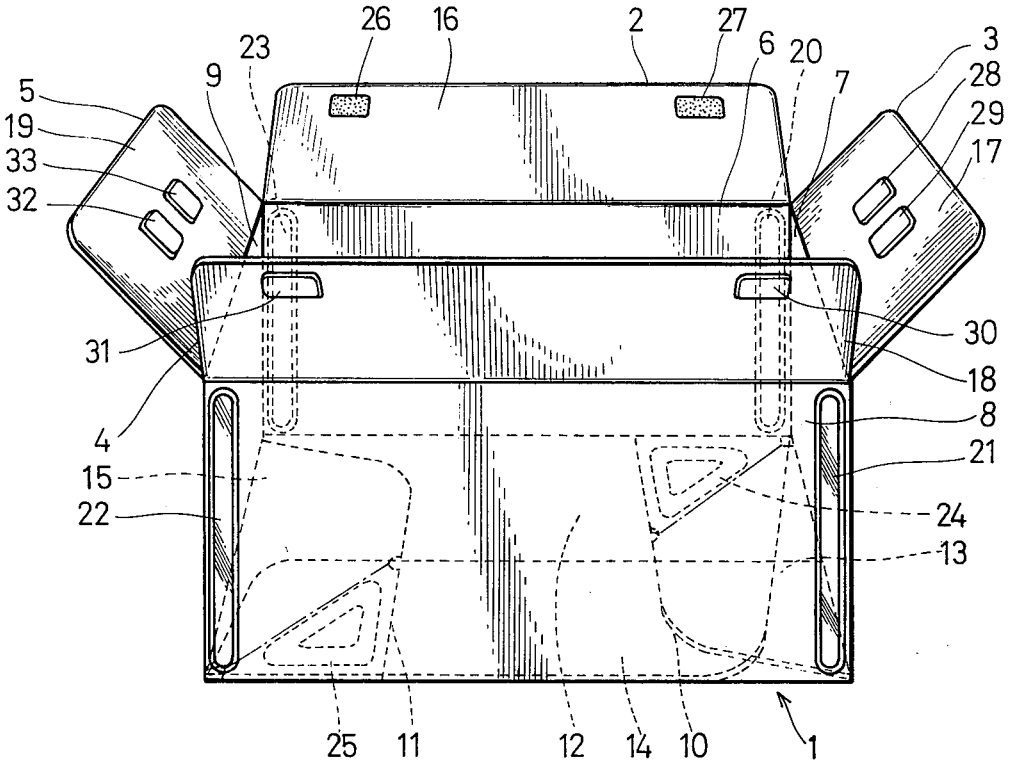
FIG. 1 is a perspective view of a preferred embodiment of a collapsible container according to the present invention but showing the same in an erected condition.

Referring now to the drawings, in FIG. 1 there is shown a container exemplary of the invention, which is generally indicated at 1, made from sheet material such as card-board, paperboard, or other suitable foldable sheet material. The container 1 consists of four panel elements 2, 3, 4, and 5. The panel elements 2, 3, 4, and 5 comprise four side walls 6, 7, 8 and 9 interconnected by four reinforcing members 20, 21, 22, and 23 disposed at opposite ends of each of the two side walls facing each other. The side walls 6, 7 include bottom flaps 12, 13 extending from the lower edges thereof and inwardly foldable. The bottom flaps 12, 13 are joined by a connector 24 to form first bottom wall means 10.

The other side walls 8, 9 include bottom flaps 14, 15 extending from the lower edges thereof and inwardly foldable. The bottom flaps 14, 15 are connected by another connector 25 to form second bottom wall means 11. The four panel elements 2, 3, 4, and 5 fourther include associated lid flaps 16, 17, 18, and 19 foldably and integrally affixed to the side walls 6, 7, 8, and 9 at the upper ends thereof. Each flap is provided on one side with hook means 26 — 33 as will be detailed later. The carton 1 may be very readily set up or collapsed by unfolding or folding first and second bottom wall means over along the edges of the respective side walls.

The general carton construction has been described with reference to FIG. 1, and now the mode of operation of the carton will be discussed hereinafter with reference to FIGS. 2 – 12 wherein like numerals are used to refer to like parts in FIG. 1.

Figure 3:
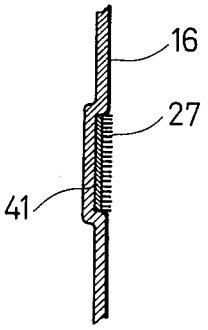
FIG. 3 is a section taken along line III—III of FIG. 2.
Figure 2:
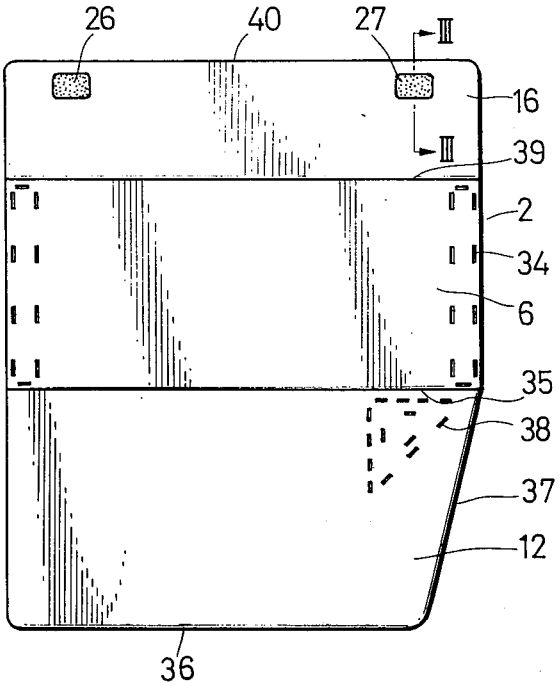
FIG. 2 is a plan view of one element of the container shown in FIG. 1 but showing the same in a developed condition.
Figure 5:
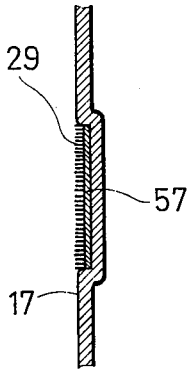
FIG. 5 is a sectional view taken along line V—V of FIG. 4.

FIG. 2 is a plan view of the panel element 2 shown in FIG. 1 in a developed condition as viewed from the inside of the container. The panel element 2 as well as the other elements 3, 4, and 5 in the instant embodiment is press cut from relatively rigid paperboard or cardboard. The panel element 2 includes the side wall 6 of longitudinal rectangular form. The side wall 6 is provided with a plurality of slots 34 at opposite ends thereof to receive lock tongues formed on each of the reinforcing members 20, 23 as will be later described. These slots 34 are formed simultaneously with forming the panel element 2. The bottom flap 12 is connected to the lower edge of the side wall 6 and foldable over along a crease 35 formed simultaneously with the press formation of the panel element 2. The bottom flap 12 is dimensioned so that the distance between the crease 35 and the flap edge 36 is somewhat shorter than the depth of the containe when assembled, and so that one side is inclined as indicated at 37 to render the flap edge 36 shorter than the longitudinal length of the side wall 6. The bottom flap 12 is also provided with a plurality of slots 38 at one end thereof to receive lock tongues formed on connector 24 as will be later described. These slots 38 are formed simultaneously with the press formation of the panel element 2. The lid flap 16 is affixed to the upper edge of the side wall 6 and foldable over along a crease 39 formed simultaneously with the press formation of the panel element 2. The lid flap 16 is dimensioned so that the distance between the crease 39 and a flap edge 40 is half of the width the container when assembled. As seen in FIG. 3, the lid flap 16 is recessed outwardly thereof as indicated at 41, and in the recess hook means 27 (a magic tape in this instant embodiment) is mounted. Another hook means 26 is also applied to a recess formed simultaneously with, press formation of the panel element 2 as in the same manner as hook means 27 in recess 41. The hook means are applied by use of adhesive.

Figure 4:
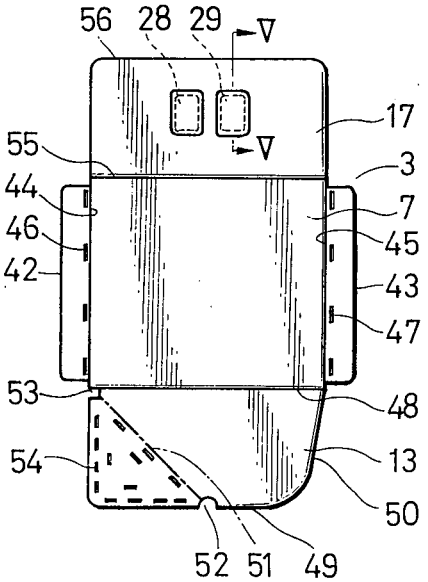
FIG. 4 is a plan view showing one-panel element of the container shown in FIG. 1 with the side wall in a developed condition.

Another panel element 3 is shown in FIG. 4 as a developed form, it is press punched from the some material, paperboard or cardboard as the panel element 2. The panel element 3 includes side wall 7 which is provided at its opposite ends with tabs 42, 43 foldable over along creases 44, 45. Each of the tabs 42, 43 has a plurality of slots 46 or 47 to receive lock tongues of reinforcing members 20, 21 as will be later detailed. These slots 46, 47 are formed simultaneously with the press formation of the panel element 3. The bottom flap 13 is affixed to the lower edge of the side wall 7 and foldable over along a crease 48. The bottom flap 13 is dimensioned so that the distance between the crease 48 and a flap edge 49 is less than half of the length of either of the side walls 6, 8, and that one side is inclined as indicated at 50 to render the flap edge 49 shorter than the longitudinal length of the crease 48. A score line 51 is drawn on the bottom flap 13 at an angle of 45° formed in the corner defined by the crease 48 and the flap edge opposite to the inclined edge 50. The bottom flap 13 is provided with force escapements 52, 53 notched at the terminal ends of the score line 51. A plurality of slots 54 are formed in the bottom flap inwardly of the score line 51 to receive lock tongues of the connector 24 as will be later described. These slots 54 are formed simultaneously with the press formation of the panel element 3.

The lid flap 17 is connected to the upper edge of the side wall 7 to fold over along a crease 55. The lid flap 17 is dimensioned so that the distance between the crease 55 and flap edge 56 is less than a half of the depth of the container 1 but the same as the width of the lid flap 16. As seen from FIG. 5, the lid flap 17 is recessed outwardly thereof as indicated at 57, and in the recess, hook means 29 such as a magic tape is mounted by adhesive. Another hook means 28 is also applied to a recess formed simultaneously with the press formation of the panel element 3.

Figure 6:
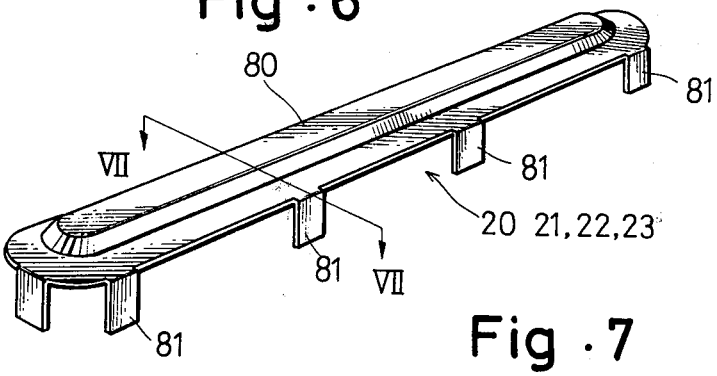
FIG. 6 is a perspective view of the reinforcing member shown in FIG. 1.
Figure 7:
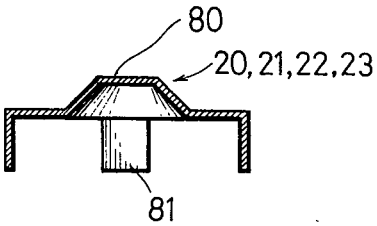
FIG. 7 is a section taken along line VII—VII of FIG. 6.

The reinforcing elements 20, 21, 22, and 23 shown in FIGS. 6 and 7 function to connect the panel element side walls 6, 7, 8, and 9 with each other and to increase longitudinal strength of the side walls 6, 7, 8, and 9. These reinforcing members are made from a press machined iron sheet of thickness on the order of 0.3 – 0.5mm and are of an elongated form. Each of the reinforcing members includes a crown 80 of a truncated cone shape in section to increase strength against bending, and a plurality of lock tongues 81 spaced from each other and extending from the periphery of the member.

Figure 8:
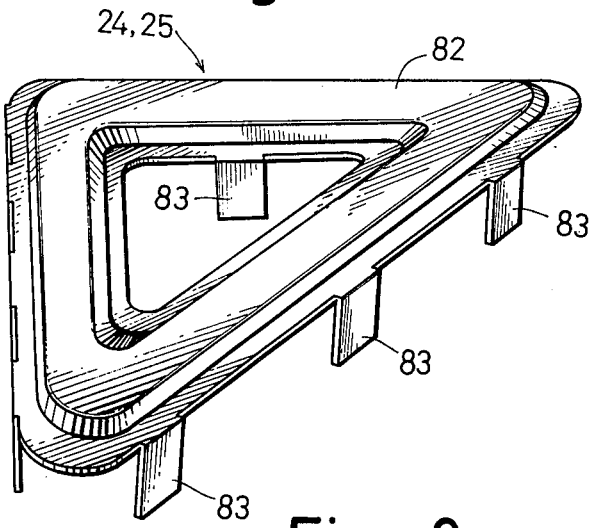
FIG. 8 is an enlarged perspective view of the connector shown in FIG. 1.

The connectors 24 and 25 shown in FIG. 8 serve to interconnect the bottom flaps 12, 13 and the other bottom flaps 14, 15, respectively. These connectors are made from a press machined iron sheet of thickness on the order of 0.3 – 0.5mm and in triangular form. Each of the connectors includes a crown 82, as in the reinforcing members, of a truncated cone shape in section, and a plurality of lock tongues 83 spaced from each other and extending from the inner and outer peripheries of the connector.

Figure 9:
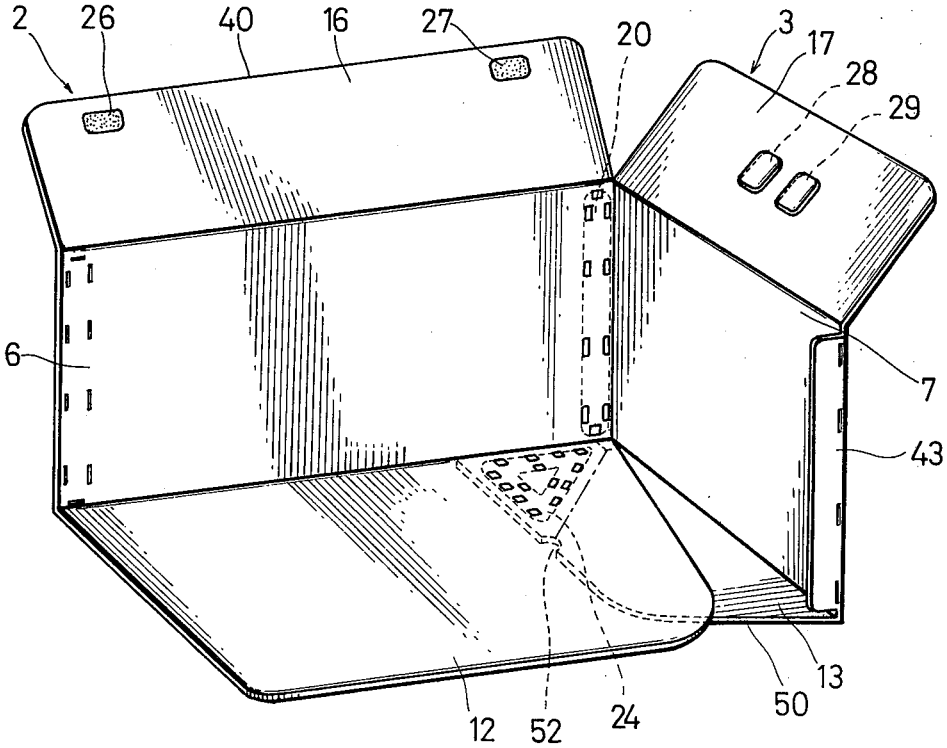
FIG. 9 is a perspective view showing the two panel elements shown in FIGS. 2 and 4 in a connective relationship.

The two panel elements 2, 3 are mutually interconnected in such juxtaposition in a manner that the tab 42 of the side wall 7 lies under the other side wall 6, to have the slots 34, 46 aligned with each other so as to receive therein the lock tongues 81 of the reinforcing member 20. The two panels 2, 3 are firmly fastened by inwardly bending the lock tongues 81. After the side walls 6, 7 have been interconnected, the bottom flap 12 is adapted to lie atop the surface of the bottom flap 13, to have the slots 38, 54 aligned with each other so as to receive therein the lock tongues 83 of the connector 24. The two bottom flaps 12, 13 are rigidly fastened by inwardly bending the lock tongues 83 to thus form first bottom wall means 10. FIG. 9 shows the two panel elements 2, 3 in a set up condition.

Figure 10:
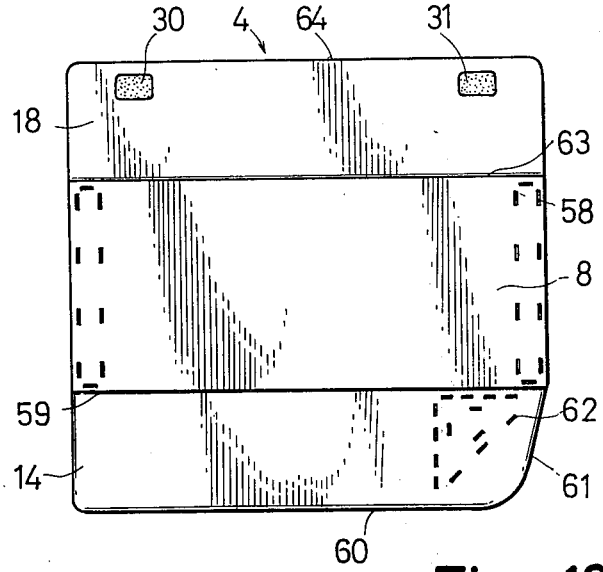
FIG. 10 is a plan view showing another panel element of the container shown in FIG. 1 with the side wall in a developed condition.
Figure 11:
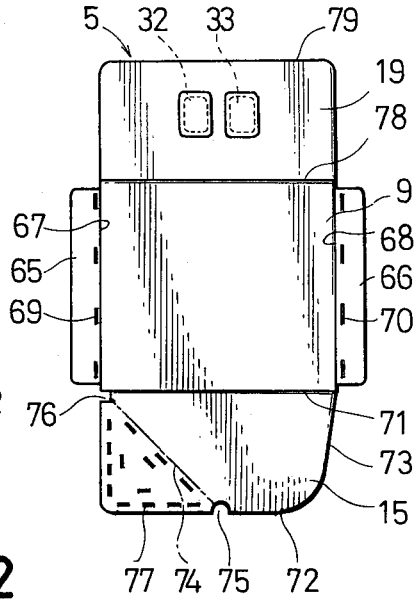
FIG. 11 is a plan view showing still another panel element in a developed condition.

The panel element 4 shown in FIG. 10 is similar to the panel element 2 in configuration. The panel element 4 includes the side wall 8 provided with a plurality of slots 58 at opposite ends thereof. The bottom flap 14 is connected to the lower edge of the side wall 8 to fold over along a crease 59 and is provided with a plurality of slots 62 at one end thereof. The bottom flap 14 is dimensioned so that its width is of less than bottom flap 12 but is half the depth of the container 1. The lid flap 18 is affixed to the upper edge of the side wall 8 to fold over along a crease 63 and is recessed outwardly thereof, in which recess hook means 30, 31 are mounted as in the panel element 2. The panel element 5 as shown in FIG. 11 is similar to the panel element 3 in configuration and includes side wall 9 which is provided at its opposite ends with tabs 65, 66 foldable over along creases 67, 68. Each of the tabs 65, 66 has a plurality of slots 69 or 70. The bottom flap 15 is connected to the lower edge of the side wall 9 to fold over along a crease 71. A score line 74 is formed on the bottom flap 15 at an angle of 45°, formed in the corner defined by the crease 71 and the flap edge opposite to edge 73, and extends to flap edge 72. The bottom flap 15 is provided with force escapements 75, 76 notched at the terminal ends of the score line 74. A plurality of slots 77 are formed in the bottom flap inwardly of the score line 74. The lid flap 19 is affixed to the upper edge of the side wall 9 to fold over along a crease 78 and is recessed to apply hook means 32, 33 thereto.

Figure 12:
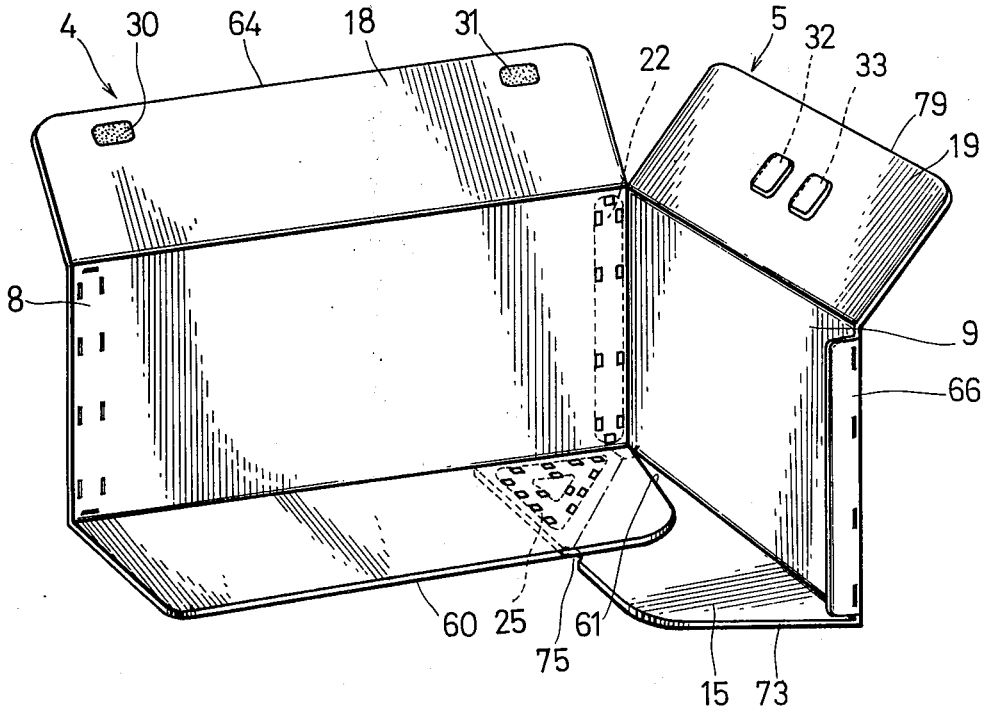
FIG. 12 is a perspective view showing the two panel elements shown in FIGS. 10 and 11 in a connective relationship.

The two panel elements 4, 5 are shown in FIG. 12 as mutually interconnected in juxtaposition. A tab 65 of the side wall 9 lies under the other side wall 8 to have the slots 69, 58 aligned with each other so as to receive therein the lock tongues 81 of the reinforcing member 22. The two panels 4, 5 are firmly fastened by inwardly bending the lock tongues 81. After the side walls 4, 5 have completed the been interconnection therebetween, the bottom flap 14 is adapted to lie atop the surface of the bottom flap 15 to have the slots 62, 77 aligned with each other so as to receive therein the lock tongues 83 of the connector 25. The two bottom flaps 14, 15, are rigidly fastened by inwardly bending the lock tongues 83 to thus form second bottom wall means 11.

Now, the panel elements 2, 3 (FIG. 9) and 4, 5 (FIG. 12) in the partially assembled state are mutually interconnected by the reinforcing members 21, 23 which fasten the tabs 43, 66 and the side walls 6, 8 together thereby forming the carton 1 set up as shown in FIG. 1.

The container 1 as above arranged can be easily collapsed into a flat position after use for storage purposes. More specifically, the first and second bottom wall means 10, 11 are inwardly pressed to fold over along the score lines 51, 74 to bring the side walls 6, 9 and 7, 8 in a coplanar relation with each other thereby rendering them flat. As a result, the first and second bottom wall means 10, 11 lie between the side walls 6, 7, 8, and 9. This will allow the cartons to be stocked in large numbers in order to conserve storage or transport space.

When it is desired to set the carton up for use, the side walls 6, 7, 8, and 9 are outstretched to unfold the wider bottom flap 12 of the first bottom wall means 10 downwardly from inside thereby causing the bottom flaps 13 and 15 to unfold over along the score lines 49, 74 formed on the first and second bottom wall means 10, 11 to obtain the base in a rectangular configuration. This will effect formation of a rectangular carton. Due to provision of the inclined edges 37, 50, 61, and 73 of the bottom flaps 12, 13, 14, and 15, and the force escapements 52, 53, 75, and 76 formed in the bottom flaps 13, 15, the carton, no matter how it is made from relatively rigid carboard, may be readily and quickly collapsed or set up by a so-called "one-press" manner without interference from the bottom flaps 12, 13, 14, and 15 and the side walls 6, 7, 8, or 9 and without undesirable friction.

When the carton is erected, the wider bottom flap 12, which has an area substantially the same as the base area of the carton, lies uppermost to cover the bottom flap 14 over the other bottom flaps 13 and 15.

When the carton is loaded with articles therein and carried, the load of the articles tends to outwardly unfold the bottom flaps but the first and second bottom wall means do not allow the bottom flaps 12, 13 14, 15 to form an angle of more than 90° with the side walls, thereby maintaining the carton in rectangular configuration. In addition, the connectors 24, 25 of rigid material serve to prevent the bottom flaps from flexing to ensure the rectangular configuration of the carton base. Further, the wider bottom flap 12 is uppermost over the other bottom flaps, so that the base is rendered planar to stably accommodate the articles in the carton.

After the carton is assembled and the articles are received therein, the opposed lid flaps 17, 19 fold upon themselves, and then the other opposed lid flaps 16, 18 fold thereupon to mutually interconnect hook means such as magic tapes to form the lid for the container. In cooperation with the thus-obtained lid and the aforementioned base, the container is able to provide a reinforced, supported structure for withstanding distortion or deformation. It will be apparent that as the side walls 6, 7, 8, and 9 are interconnected by the respective reinforcing members 20, 21, 22, and 23 the container can function as a goods-delivery box well fit for repeated uses.

The container may be constructed of solid fiber or corrugated paperboard or cardboard. The container may be coated with any waterproofing agent for the necessary degree of water-resistance. It is also conceived that a film or layers of polypropylene may be placed over the paper-board to obtain a water-resistant, proof tensile container. Where the paperboard is coated with a film of polypropylene, it is possible to connect the panel elements by use of a high frequency wave or a supersonic wave welder.

Although the connector 24 or 25 is configurated to be in a triangular form, it may be in an elongated form like the reinforcing member. The bottom flaps may be connected by rivets or the like.

According to the present invention, the container is obtained by press machining or like processing a plurality of the panel elements and connecting the latter by the reinforcing members and the connectors. This will consequently require no extra steps of manufacture and assembly, resulting in an inexpensive product.

An embodiment of the present invention has been set forth in detail for purposes of making a complete disclosure thereof; however, numerous modifications will occur to one skilled in the art without departing from the spirit of the invention.

What is claimed is:

1. A collapsible container comprising four mutually interconnected rectangular side walls made from paperboard or cardboard; first bottom wall means extending from the lower edges of a first pair of the side walls adjacent to each other, and inwardly foldable, said first bottom wall means being in right angle relation with said first pair of the side walls when said container is erected; second bottom wall means extending from the lower edges of the other, second pair of side walls adjacent to each other, and inwardly foldable, said second bottom wall means being in right angle relation with the second pair of side walls and adapted to lie over said first bottom wall means when said container is erected; a first score line formed on said first bottom wall means to permit the latter to fold between said first pair of the side walls; a second score line formed on said second bottom wall means to permit the latter to fold between said second pair of the side walls; and a plurality of reinforcing members of hard or rigid material disposed along the opposite ends of each of said side walls.

2. A collapsible container as defined in claim 1 wherein lid flaps are formed at the upper edges of the respective side walls to fold over along said edges and define the lid of the container when the container is erected.

3. A collapsible container as defined in claim 2 wherein said first bottom wall means are foldably mounted on said first pair of side walls, and consist of bottom flaps mutually interconnected by a connector, and wherein said second bottom wall means are foldably mounted on said second paid of side walls, and consist of another pair of bottom flaps mutually interconnected by another connector.

4. A collapsible container as defined in claim 3 wherein said four side walls and their respective bottom flaps and lid flaps constitute four panel elements each including one side wall, bottom flap, and lid flap, said reinforcing members functioning to interconnect said side walls of said panel elements.

5. A collapsible container as defined in claim 4 wherein one of said bottom flaps is dimensioned to have an area substantially equal to the base of the container.

6. A collapsible container as defined in claim 5 wherein two opposed lid flaps lie atop the other two lid flaps when the container is erected, and have a width equal to half the length of the other two lid flaps.

7. A collapsible container as defined in claim 6 wherein mutually bondable hook means are disposed on the bottom surfaces of the two lid flaps which lie atop the other two lid flaps, and on the top surfaces of the other two lid flaps.

* * * * *

UNITED STATES PATENT OFFICE

CERTIFICATE OF CORRECTION

Patent No. 4,034,909 Dated July 12, 1977

Inventor(s) Mitsunori Toda

It is certified that error appears in the above-identified patent and that said Letters Patent are hereby corrected as shown below:

IN THE ABSTRACT: Line 9, "core" should read --score--.

IN THE SPECIFICATION: Col. 1, line 8, delete first occurrence of "and" and substitute --,--; delete "in"; delete first comma and insert --and--; col. 1, line 10, "carboard" should read --cardboard--; col. 1, line 16, delete "be"; col. 1, line 21 delete "are"; col. 1, line 39, delete the comma; col. 2, line 1, delete "in"; col. 2, line 9, insert --is of increased-- after "lid"; col. 2, line 10, insert --,-- after "strength"; delete "which" and insert --to--; col. 2, line 14, delete "is"; col. 2, line 31, delete the hyphen; col. 3, line 6, "fourther" should read --further--; col. 3, line 36, "containe" should read --container--; col. 3, line 48, delete "of"; insert --of-- after "width"; col. 3, line 51, insert --,-- after "recess"; col. 3, line 54, delete the comma after "with"; insert --the-- after "with"; insert --,-- after "2"; col. 3, line 58, insert --,-- after "form"; "some" should read --same--; col. 4, line 50, delete "such"; insert --such-- after "manner"; col. 5, line 3, delete "of"; col. 5, line 32, delete "completed the";

UNITED STATES PATENT OFFICE

CERTIFICATE OF CORRECTION

Patent No. 4,034,909 Dated July 12, 1977

Inventor(s) Mitsunori Toda Page 2 of 2

It is certified that error appears in the above-identified patent and that said Letters Patent are hereby corrected as shown below:

"interconnection" should read --interconnected--; col. 5, line 68, "carboard" should read --cardboard--.

IN THE CLAIMS: Claim 3, Col. 7, line 23, "paid" should read --pair--.

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*